US011383151B2

(12) United States Patent
Hutt

(10) Patent No.: US 11,383,151 B2
(45) Date of Patent: Jul. 12, 2022

(54) AUTOMATED GAME SCORING AND PIN TRACKING SYSTEM

(71) Applicant: FOWLING ENTERPRISES, LLC, Hamtramck, MI (US)

(72) Inventor: Christopher Hutt, Hamtramck, MI (US)

(73) Assignee: FOWLING ENTERPRISES, LLC, Hamtramck, MI (US)

( * ) Notice: Subject to any disclaimer, the term of this patent is extended or adjusted under 35 U.S.C. 154(b) by 12 days.

(21) Appl. No.: 16/325,956

(22) PCT Filed: Aug. 17, 2017

(86) PCT No.: PCT/US2017/047301
§ 371 (c)(1),
(2) Date: Feb. 15, 2019

(87) PCT Pub. No.: WO2018/035297
PCT Pub. Date: Feb. 22, 2018

(65) Prior Publication Data

US 2019/0201777 A1 Jul. 4, 2019

Related U.S. Application Data

(60) Provisional application No. 62/376,101, filed on Aug. 17, 2016.

(51) Int. Cl.
*A63D 5/04* (2006.01)
*A63D 9/00* (2006.01)

(52) U.S. Cl.
CPC *A63D 5/04* (2013.01); *A63D 9/00* (2013.01)

(58) Field of Classification Search
CPC ... A63D 5/00; A63D 5/04; A63D 5/08; A63D 5/06; A63B 67/002; A63B 67/06
(Continued)

(56) References Cited

U.S. PATENT DOCUMENTS 2,346,428 A * 4/1944 Hanley ..... A63D 9/00 473/69
4,442,507 A 4/1984 Roesner
(Continued)

FOREIGN PATENT DOCUMENTS

WO 2006111700 A1 10/2006

OTHER PUBLICATIONS

Fowling.org, "Equipment Required", fowling.org/Fowling-Equipment-Required.htm, archived Apr. 21, 2010 (Year: 2010).*
(Continued)

*Primary Examiner* — Laura Davison
(74) *Attorney, Agent, or Firm* — Blue Filament Law PLLC

(57) ABSTRACT

An automated system is provided for scoring and tracking pin position and pin placement, gameplay, and playing time during games of FOWLING™. A modified pin with a radio frequency identification (RFID) tag affixed to or implanted in the pin provides tracking of individual pins during gameplay. A RFID reader is used to poll the set of pins on the platform to determine when a pin has left a set position. A processor controls the RFID tag reader and a clock so as to track pin position versus time. A pin position array is used in conjunction with conductive or magnetic disks on the bottom portion or surface of the pin for tracking pin position, pin placement, and gameplay. The conductive or magnetic disks complete circuit junctions in the array that confirm the presence of a standing pin and when a pin has been dislodged and presumably toppled over.

14 Claims, 2 Drawing Sheets

(58) Field of Classification Search
USPC ..... 473/69–71
See application file for complete search history.

(56) References Cited

U.S. PATENT DOCUMENTS

| | | | | |
|---|---|---|---|---|
| 4,796,074 | A | 1/1989 | Roesner | |
| 5,095,362 | A | 3/1992 | Roesner | |
| 5,296,722 | A | 3/1994 | Potash et al. | |
| 5,347,263 | A | 9/1994 | Carroll et al. | |
| 5,347,280 | A | 9/1994 | Schuermann | |
| 5,378,880 | A | 1/1995 | Eberhardt | |
| 5,407,851 | A | 4/1995 | Roesner | |
| 5,430,441 | A | 7/1995 | Bickley et al. | |
| 5,521,601 | A | 5/1996 | Kandlur et al. | |
| 5,528,222 | A | 6/1996 | Moskowitz et al. | |
| 5,541,604 | A | 7/1996 | Meier | |
| 5,550,547 | A | 8/1996 | Chan et al. | |
| 5,565,846 | A | 10/1996 | Geiszler et al. | |
| 5,625,341 | A | 4/1997 | Giles et al. | |
| 5,682,143 | A | 10/1997 | Brady et al. | |
| 6,325,725 | B1 | 12/2001 | Tsujita | |
| 6,580,954 | B1 | 6/2003 | Shea | |
| 7,030,736 | B2 * | 4/2006 | Bouchard | A63D 9/00 340/323 B |
| 10,018,450 | B2 * | 7/2018 | Loetz, Jr. | F41J 7/04 |
| 2002/0116274 | A1 * | 8/2002 | Hind | G06K 19/07749 705/23 |
| 2005/0164797 | A1 * | 7/2005 | Jacover | A63D 5/04 473/70 |
| 2005/0272511 | A1 | 12/2005 | Bouchard et al. | |
| 2007/0190495 | A1 * | 8/2007 | Kendir | F41A 33/02 434/21 |
| 2009/0143883 | A1 | 6/2009 | Pines et al. | |
| 2015/0148129 | A1 * | 5/2015 | Austerlade | H04L 43/04 463/31 |
| 2015/0285593 | A1 * | 10/2015 | Dribben | F41J 5/10 434/19 |
| 2016/0195369 | A1 * | 7/2016 | Perry | F41J 7/04 434/19 |

OTHER PUBLICATIONS

Wikipedia.org, "Shot clock", en.wikipedia.org/wiki/Shot_clock, archived Jan. 8, 2015 (Year: 2015).*

"Bowling pin shooting", Wikipedia, en.wikipedia.org/wiki/Bowling_pin_shooting, archived Jul. 5, 2015 (Year: 2015).*

International Search Report dated Nov. 15, 2017 for International Application No. PCT/US2017/047301 filed Aug. 17, 2017.

* cited by examiner

AUTOMATED GAME SCORING AND PIN TRACKING SYSTEM

CROSS-REFERENCE TO RELATED APPLICATION

This application claims priority of U.S. Provisional Patent Application Ser. No. 62/376,101 filed Aug. 17, 2016, which is incorporated herein by reference.

FIELD OF THE INVENTION

The present invention in general relates to games, and in particular to an automated system for providing ancillary features of at least one of scoring and tracking pin position and pin placement, gameplay, and playing time during games of FOWLING™ and FOWLING™ competitions.

BACKGROUND OF THE INVENTION

FOWLING™ is a sports game that involves throwing a football at an array of pins in order to knock down as many pins as possible in the shortest amount of time. The pins used in FOWLING™ are generally of the same dimensions and weight as standard pins used in bowling. FOWLING™ is either played one-on-one, with teams of two, or involves doubles play, where participants or teams stand on opposite ends called lanes. In doubles play, teammates are positioned on the same lane and throw at the opposing team's lane. A game starts with a coin toss where the winner is granted the decision whether to fowl first or choose a lane to defend and defer to the other team to decide on FOWLING™ first. Each team alternates throwing the football at their opponent's pins while also alternating fowlers within the team. Each player has 20 seconds to throw starting from their intention on throwing. An imaginary foul line is designated for men and women who are throwing. Men are allowed to throw anywhere behind the back edge of the lane and women may throw from anywhere behind the front edge of the lane. Players may use any throwing style, but must throw from the same location during each frame and must throw with the same arm for an entire match unless a medical emergency permits otherwise. At no time are players allowed to interfere with the throwing of the ball or the ball contacting the pins. Defense is authorized only when a ball has crossed the foul line and technically the ball is still in play until the ball stops. Any rule violation results in a foul throw for the other team and the other team regains possession as well regardless of throwing rotation predicted by the coin toss. Special prizes may be awarded based on hitting only specified pins. For example, a prize may be awarded when a player achieves a "bonk," which means downing only the middle pin on a first throw.

A FOWLING™ match is broken down into frames. In match play, one frame is completed when all pins of an opponent are knocked down on either lane. The team that accomplishes knocking down all their opponent's pins first wins the frame. The game of FOWLING™ is declared over when a team wins two out of three frames. A tie occurs when the team that throws last knocks down all the other team's pins. In the case of a tie, overtime is invoked in a sudden death contest to determine the winner. Both teams place one pin anywhere on the FOWLING™ lane for their opponents to throw at. A coin toss determines who throws first and no equalizer throw is allowed. The team that knocks their opponent's pin down first wins the match.

FIG. 1 illustrates a typical prior art set up 10 for a game of FOWLING™. A lane surface 12 is a forty two inch by ninety six inch (42"×96") rectangle on a platform 14 constructed of half inch plywood fastened to a two inch by four inch (2"×4") wood frame edge. Each game set up 10 has two lane surfaces 12 placed forty eight feet (48') apart, where the spacing defines a neutral zone 16 between the front edge lines 18 that mark the forward placement of the lane surfaces 12 that are facing each other. A back edge lines 20 define the rear placement of the lane surfaces 12. Men are allowed to throw the football anywhere behind the back edge lines 20 of the lane, and women may throw the football from anywhere behind the front edge lines 18 of the lane. The bowling pins 22 are of standard regulation size and weight and are arranged in a standard triangular bowling pin formation with equidistant twelve inch (12") spacing between each pin from center to center.

While the popularity of FOWLING™ has been growing, there is currently no automated system for scoring and tracking gameplay, playing time, pin position and pin placement during FOWLING™ competitions. Thus, there exists a need for an automated monitoring system for use in FOWLING™ gameplay.

SUMMARY OF THE INVENTION

A system is provided for scoring and tracking pin position and pin placement, gameplay, and playing time during pin games or pin game competitions. The system includes a set of platforms spaced apart to form a court, with two sets of pins for placement on each platform of the set of platforms, where each individual pin that forms the two sets of pins is configured with a radio frequency identification (RFID) tag. An RFID reader is in electrical communication with the RFID tags.

A system is provided for scoring and tracking pin position and pin placement, gameplay, and playing time during pin games or pin game competitions. The system includes a set of platforms spaced apart to form a court with two sets of pins for placement on each platform of the set of platforms, where each individual pin that forms the two sets of pins is configured with a radio frequency identification (RFID) tag and a conductive or magnetic disk on a bottom portion or surface of the pin. A pin position array with a series of conductive pin placement pads joined by a conductive grid on a top surface of each of the platforms, where the conductive or magnetic disks on the bottom portion or surface of each of the individual pins complete circuit junctions in the pin position array that confirm the presence of a standing pin and when a pin has been dislodged and presumably toppled over. An RFID reader is in electrical communication with the RFID tags.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DESCRIPTION OF THE INVENTION

The present invention has utility as an automated system for scoring and tracking pin position and pin placement, gameplay, and playing time during games of FOWLING™ and FOWLING™ competitions. These games are also referred to generically as pin games or pin game competitions, respectively. Embodiments of the invention provide a modified pin with a radio frequency identification (RFID) tag affixed to or implanted in the pin that allows for tracking of individual pins during gameplay. A RFID reader may be used to poll the set of pins on the platform to determine when a pin has left a set position. A processor may be used to control the RFID tag reader and a clock so as to track pin position versus time. The processor may be configured to record the positions and times that pins have been dislodged, as well as the total time required to knock down all of the pins. The processor may be part of a device having data input and output capacity, processor support circuitry, memory circuitry and an executable program for analysis of data transmitted from the RFID tags via the tag reader that is in data communication with the RFID tags associated with each of the pins. In specific embodiments a pin position array may be used in conjunction with conductive or magnetic disks on the bottom portion or surface of the pin for tracking pin position, pin placement, and gameplay. The conductive or magnetic disks complete circuit junctions in the array that confirm the presence of a standing pin and when a pin has been dislodged and presumably toppled over. The processor reads the array to track pin position, pin placement, and gameplay. A light indicator ("green light") may be provided on the platform to indicate that the pins are set up and properly placed in the pin pattern, so that a game may be started. In tournament play the speed at which a game of FOWLING™ is completed may be used as a ranking parameter for participants or teams. The processor may be connected to and control a timing display to inform participants of various match related times, such as time to throw in a player's turn. Real-time gaming information may also be made available to Internet enabled devices, such as smartphones, tablets, and personal computing devices. Player and team rankings may be posted to a website.

Figure 1:
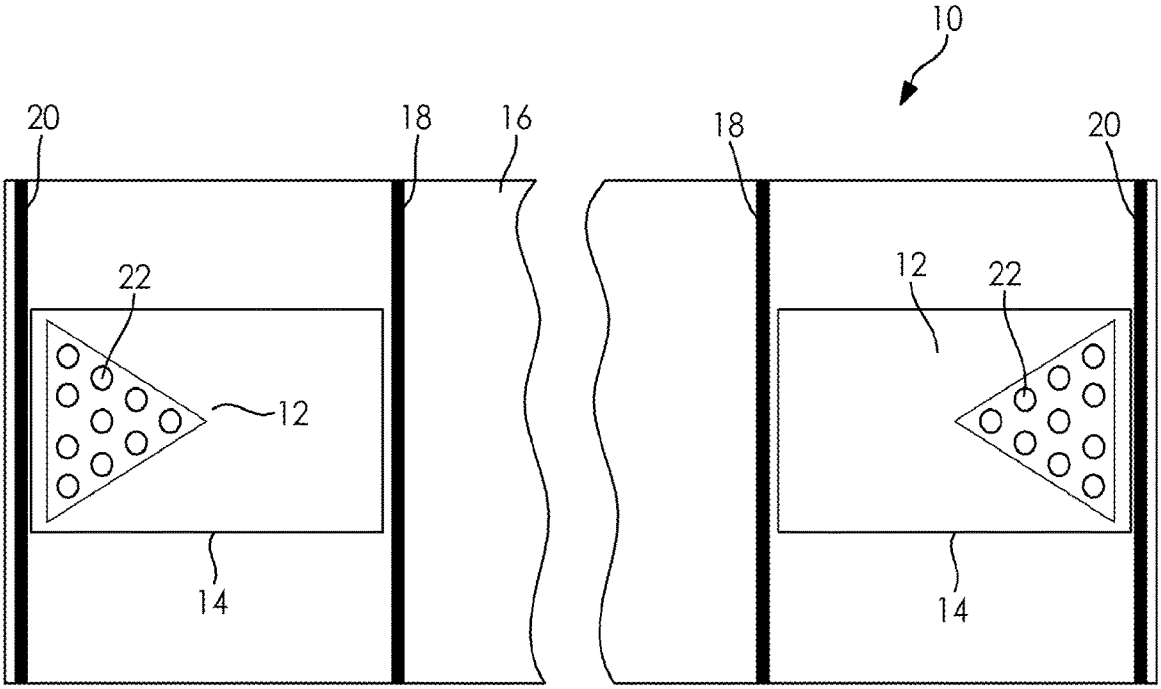
FIG. 1 (PRIOR ART)
FIG. 1 is a prior art view of a set up for a standard game of FOWLING™ game.
Figure 2:
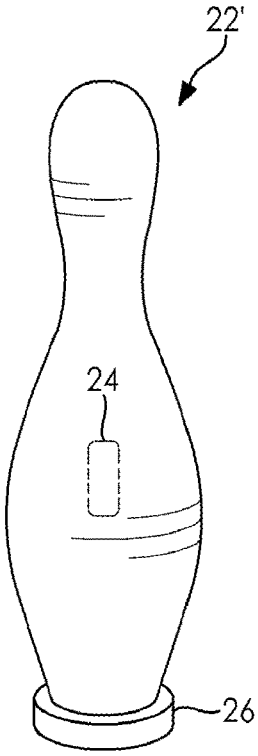
FIG. 2 is a perspective view of a modified pin with a radio frequency identification tag affixed to or implanted in the pin, and a conductive or magnetic base in accordance with embodiments of the invention.

Referring now to the figures, FIG. 2 is a perspective view of a modified pin 22' with a radio frequency identification tag 24 affixed to or implanted in the pin 22', and a disk 26 forming a conductive or magnetic base at the bottom of the pin 22'. It is noted that the position of the RFID tag 24 is for illustration only and may be positioned anywhere in or on the pin 22'. It is also noted that the pin 22' may have either the RFID tag 24 or the conductive or magnetic disks 26.

Figure 3:
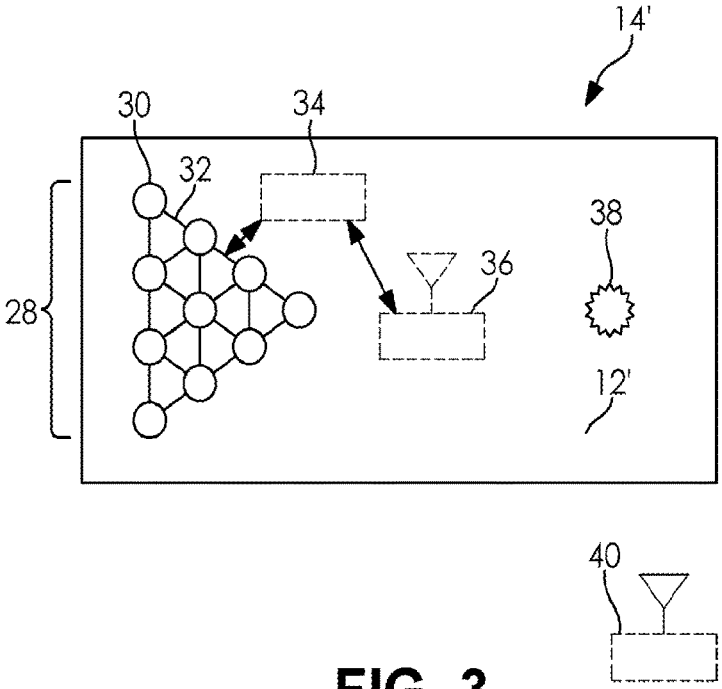
FIG. 3 is top perspective view of a FOWLING™ lane with a pin position array, a processor, and a radio frequency identification reader in accordance with embodiments of the invention.

FIG. 3 is top perspective view of a FOWLING™ lane platform 14' with a pin position array 28, a processor/controller 34, and a radio frequency identification (RFID) reader 36. The pin position array 28 has a series of conductive pin placement pads 30 on the lane surface 12'. The pin placement pads 30 are joined by a conductive grid 32 that is in electrical communication with the processor/controller 34. The pin placement pads 30 may be used in conjunction with conductive or magnetic disks 26 on the bottom portion or surface of the pin 22' for tracking pin position, pin placement, and gameplay. The conductive or magnetic disks 26 complete circuit junctions in the array 28 that confirm the presence of a standing pin and when a pin has been dislodged and presumably toppled over. The RFID reader 36 interrogates the RFID tags 24 of the pins 22', and is in electrical communication with the processor/controller 34. It is noted that one or both of the pin position array 28 and RFID reader 36 may be present on the platform 14' depending on the type of pins used. A light indicator 38 ("green light") may be provided on the platform to indicate that the pins are set up and properly placed in the pin pattern, so that a game may be started.

Continuing with FIG. 3, one or more master RFID readers 40 may be positioned near exits from a facility housing FOWLING™ lanes in certain inventive embodiments in order to deter theft of pins 22' that are fitted with RFID tags 24. In the event a participant attempts to leave the facility with a FOWLING™ pin 22', the RFID reader 40 will detect the pin 22' at the exit and an alarm will be sounded to alert personnel of the errant pin 22'.

Figure 4:
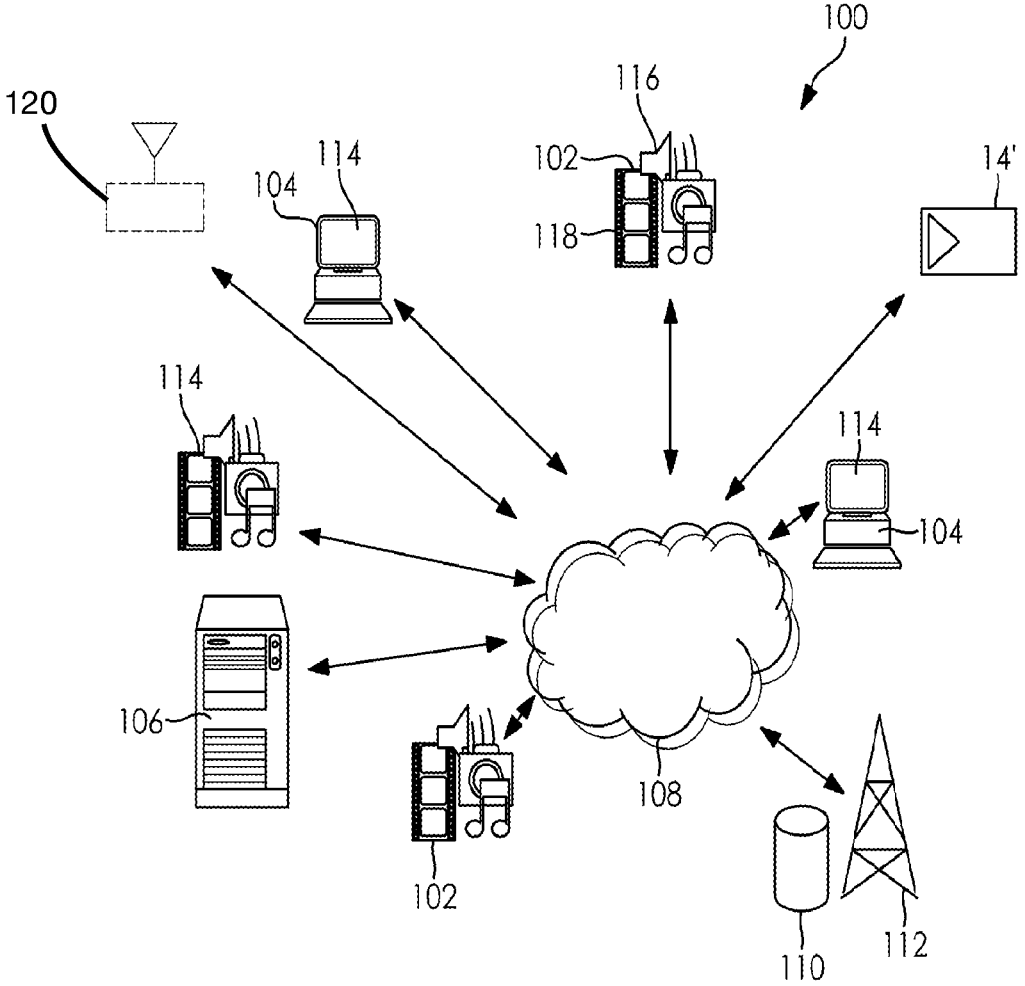
FIG. 4 is a schematic diagram illustrating an overall view of communication devices, computing devices, and mediums for implementing embodiments of the invention.

FIG. 4 is a schematic diagram illustrating an overall view of communication devices, computing devices, and mediums for implementing a system and method for an automated system for scoring and tracking pin position and pin placement, gameplay, and playing time during games of FOWLING™ and FOWLING™ competitions.

The system 100 includes multimedia devices 102 and desktop computer devices 104 configured with display capabilities 114 and processors for executing instructions and commands. The multimedia devices 102 are optionally mobile communication and entertainment devices, such as cellular phones, tablets, mobile computing devices, and gaming consoles that in certain embodiments are wirelessly connected to a network 108. The multimedia devices 102 typically have video displays 118 and audio outputs 116. The multimedia devices 102 and desktop computer devices 104 are optionally configured with internal storage, software, and a graphical user interface (GUI) for carrying out elements of the system for an automated system for scoring and tracking pin position and pin placement, gameplay, and playing time during games of FOWLING™ and FOWLING™ competitions. The network 108 is optionally any type of known network including a fixed wire line network, cable and fiber optics, over the air broadcasts, satellite 120, local area network (LAN), wide area network (WAN), global network (e.g., Internet), intranet, etc. with data/Internet capabilities as represented by server 106. Communication aspects of the network are represented by cellular base station 110 and antenna 112. In a preferred embodiment, the network 108 is a LAN and each remote device 102 and desktop device 104 executes a user interface application (e.g., Web browser) to contact the server system 106 through the network 108. Alternatively, the remote devices 102 and 104 may be implemented using a device programmed primarily for accessing network 108 such as a remote client.

The software for the system for an automated system for scoring and tracking pin position and pin placement, gameplay, and playing time during games of FOWLING™ and FOWLING™ competitions may be resident on tablets, 102 desktop or laptop computers 104, or stored within the server 106 or cellular base station 110 for download to an end user. Server 106 may implement a cloud-based service for implementing embodiments of a platform for league based FOWLING™ with a multi-tenant database for storage of separate client data for each independent user carried out on the platform.

Various types of machine readable wireless tag and reader combinations may be used in the inventive system. In one embodiment, the tags are RFID passive tags, those that transmit information only in response to interrogation by a reader. In general, a passive tag is energized to transmit identification information by the reader. Passive tags may include an energy source, such as a battery, for example to increase read range. Such tags are often termed semi-passive or battery-assisted passive. In another embodiment, the tags are RFID active tags and may initiate information transmission. Active tags are powered by an energy source, such as a battery, and may transmit continuously or intermittently. Numerous radio frequency identification readers and tags have been developed illustratively including those described in U.S. Pat. Nos. 4,442,507; 4,796,074; 5,095,362; 5,296,722; 5,347,263; 5,347,280; 5,378,880; 5,407,851; 5,430,441; 5,528,222; 5,550,547; 5,521,601; 5,541,604; 5,565,846; 5,682,143; and 5,625,341.

In one embodiment, the radio frequency tags are read-only. Such RFID tags are known in the art and are exemplified by the "ES600-Series Read Only Tags" commercially available from Escort Memory Systems (EMS), Scotts Valley, Calif. Alternatively, tags are configured to allow information to be written to the tag. For instance, the pin number or placement position may be written to the machine readable wireless tags. Read-write RFID tags are known in the art and include IntelliTag Series from Intermec Technologies Corporation and the HMS-100 Series passive read-write tags available from EMS.

A machine readable wireless tag reader is included in an inventive system which is configured to interrogate the tag and receive information from the tag. The reader is in data communication with a device having input and output capacity, processing and memory circuitry, along with an executable program for analysis of data transmitted from the tag. Exemplary devices include a personal digital assistant, personal computer or mainframe computer. The device may be built into the FOWLING™ platform or optionally, the device is portable. The reader may be in wireless or direct wired connection to the device for communication of data. In addition, information received from the tag may be input from an RFID reader over a wired or wireless connection to a device such as a server or computer network accessible by multiple users from multiple locations. The server may be any type of computer system such as a personal digital assistant, personal computer, workstation, or mainframe computer as illustrated in FIG. 4.

In some inventive embodiments, a reader is directly incorporated in a device including processing and memory circuitry as described above. Such devices illustratively include an RFID reader with database and processor components, a personal digital assistant having a reader capability or personal computer having reader capability.

The foregoing description is illustrative of particular embodiments of the invention, but is not meant to be a limitation upon the practice thereof. The following claims, including all equivalents thereof, are intended to define the scope of the invention.

The invention claimed is:

1. A system for scoring and tracking pin position and pin placement, gameplay, and playing time during a pin game or pin game competitions, said system comprising:

a set of platforms configured to be spaced apart to form a court, each of the platforms having a series of conductive pin placement pads arranged in a triangular array and joined by a conductive grid;

two sets of pins, where each individual pin that forms the two sets of pins is configured with a radio frequency identification (RFID) tag and with a conductive or magnetic disk, and where each individual pin of the two sets of pins are configured to be placed on a conductive pin placement pad of the series of conductive pin placement pads to complete circuit junctions in the triangular array of each platform to confirm the presence of a standing pin and when a pin has been dislodged from one of the set of pins;

a light indicator on each of said platforms to indicate that all of the individual pins of each of the two sets of pins are initially set up and properly placed in the triangular array of each of said platforms;

an RFID reader in electrical communication with said RFID tags;

a processor in electrical communication with the conductive grid of each of said platforms and in electrical communication with said RFID reader and controlling said RFID reader, said processor running an executable program for analysis of data transmitted from said RFID tags via said RFID reader;

a clock controlled by said processor; and wherein said processor records a time from said clock that each pin is dislodged from the triangular array of each of the two sets by a ball, and a total time from said clock required to knock down all of the pins of one of the two sets of pins by the ball.

2. The system of claim 1 further comprising a timing display of various match related times.

3. The system of claim 1 wherein said processor is part of a device, said device further comprising:

a data input and output capacity, processor support circuitry, and memory circuitry.

4. The system of claim 3 wherein the analyzed data is made available to Internet enabled devices via a network connection.

5. The system of claim 3 wherein the analyzed data is available in real-time.

6. The system of claim 3 wherein the analyzed data is posted to a website as to player and team rankings.

7. The system of claim 1 further comprising one or more master RFID readers positioned near one or more exits from a facility housing the pin games or the pin competitions in order to deter theft of said individual pins configured with said RFID tags.

8. A system for scoring and tracking pin position and pin placement, gameplay, and playing time during a pin game or pin game competitions, said system comprising:

a set of two platforms configured to be spaced apart to form a court;

two sets of pins, each of the two sets of pins for placement in a triangular array on each platform of said set of two platforms, where each individual pin that forms the two sets of pins is configured with a radio frequency identification (RFID) tag and a conductive or magnetic disk on a bottom portion or surface of said individual pin;

a pin position array with a series of conductive pin placement pads joined by a conductive grid on a top surface of each of said set of two platforms, the pin position array collocated with the triangular array on each of said set of two platforms, where the conductive or magnetic disks on the bottom portion or surface of each of said individual pins complete circuit junctions in said pin position array on each platform of said set of two platforms that confirm the presence of a standing pin and when a pin has been dislodged from a set of the two sets of pins;

an RFID reader associated with each individual platform of said set of two platforms, each RFID reader in electrical communication with said RFID tags for a set of pins from the two sets of pins placed on a respective platform from said set of two platforms;

a processor associated with each of said set of two platforms in electrical communication with said RFID reader and said pin position array for a respective platform from said set of two platforms, said processor controlling said RFID reader and running an executable program for analysis of data transmitted from said RFID tags via said RFID reader;

a single light indicator on each of said platforms to indicate that all of the individual pins of each of the two sets of pins positioned thereon are initially set up and properly placed on the pin position array of each of said platforms, so that the pin game or the pin game competition can be started;

a clock associated with each of said set of two platforms controlled by said processor associated with a respective platform from said set of two platforms; and wherein said processor records a time from said clock that each pin is dislodged from the triangular array of each of the two sets by a ball, and a total time from said clock required to knock down all of the pins of one of the two sets of pins by the ball.

9. The system of claim 8 further comprising a timing display of various match related times.

10. The system of claim 8 wherein said processor is part of a device, said device further comprising:

a data input and output capacity, processor support circuitry, and memory circuitry.

11. The system of claim 10 wherein the analyzed data is made available to Internet enabled devices via a network connection.

12. The system of claim 10 wherein the analyzed data is available in real-time.

13. The system of claim 10 wherein the analyzed data is posted to a website as to player and team rankings.

14. The system of claim 8 further comprising one or more master RFID readers positioned near one or more exits from a facility housing the pin games or pin game competitions.

* * * * *